US010215505B2

(12) United States Patent
Blomgren

(10) Patent No.: US 10,215,505 B2
(45) Date of Patent: Feb. 26, 2019

(54) HEAT TRANSFER PLATE AND PLATE HEAT EXCHANGER

(71) Applicant: ALFA LAVAL CORPORATE AB, Lund (SE)

(72) Inventor: Fredrik Blomgren, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 283 days.

(21) Appl. No.: 15/036,016

(22) PCT Filed: Dec. 2, 2014

(86) PCT No.: PCT/EP2014/076182
§ 371 (c)(1),
(2) Date: May 11, 2016

(87) PCT Pub. No.: WO2015/090930
PCT Pub. Date: Jun. 25, 2015

(65) Prior Publication Data

US 2016/0282058 A1 Sep. 29, 2016

(30) Foreign Application Priority Data

Dec. 18, 2013 (EP) ..... 13198062

(51) Int. Cl.
*F28F 3/04* (2006.01)
*F28F 3/08* (2006.01)
*F28D 9/00* (2006.01)

(52) U.S. Cl.
CPC ..... *F28F 3/046* (2013.01); *F28D 9/005* (2013.01); *F28F 3/083* (2013.01)

(58) Field of Classification Search
CPC ... F28F 3/046; F28F 3/083; F28F 3/10; F28D 9/005; Y10S 165/367
See application file for complete search history.

(56) References Cited

U.S. PATENT DOCUMENTS 5,727,620 A * 3/1998 Schaufele ..... F28F 3/10 165/166
5,887,650 A * 3/1999 Yang ..... F28F 3/10 165/166

(Continued)

FOREIGN PATENT DOCUMENTS

CN 1187615 A 7/1998
CN 200946997 Y 9/2007

(Continued)

OTHER PUBLICATIONS

English translation of a Korean Office Action issued in Korean Application No. 10-2016-7019390 dated Sep. 8, 2017.

(Continued)

*Primary Examiner* — Jon T. Schermerhorn, Jr.
(74) *Attorney, Agent, or Firm* — Birch, Stewart, Kolasch & Birch, LLP

(57) ABSTRACT

A heat transfer plate and a plate heat exchanger are provided. The heat transfer plate includes an edge portion extending along an edge of the heat transfer plate and being corrugated so as to include alternately arranged ridges and valleys as seen from a first side of the heat transfer plate. The ridges and valleys extend perpendicularly to the edge of the heat transfer plate, a first one of the ridges having a top portion extending in a top portion plane, and a first one of the valleys, which is adjacent to the first ridge, having a bottom portion extending in a bottom portion plane. The top portion of the first ridge and the bottom portion of the first valley are connected by a main flank and end, just like the main flank, at an end distance from the edge of the heat transfer plate. The heat transfer plate is characterized in that a slope of the main flank in relation to the bottom portion plane as seen from the bottom portion of the first valley is varying between a minimum slope and a maximum slope along the top portion of the first ridge and the bottom portion of the first valley.

11 Claims, 5 Drawing Sheets

(56) References Cited

U.S. PATENT DOCUMENTS

| | | | | |
|---|---|---|---|---|
| 6,073,687 | A * | 6/2000 | Jensen | F28F 3/083 165/166 |
| 9,217,608 | B2 * | 12/2015 | Krantz | F28F 3/10 |
| 9,518,782 | B2 * | 12/2016 | Blomgren | F28D 9/005 |
| 2003/0102107 | A1 * | 6/2003 | Nilsson | F24H 1/121 165/70 |
| 2009/0194267 | A1 * | 8/2009 | Gustafsson | F28D 9/005 165/168 |
| 2010/0175858 | A1 | 7/2010 | Miao et al. | |
| 2010/0258284 | A1 * | 10/2010 | Krantz | F28D 9/005 165/166 |

FOREIGN PATENT DOCUMENTS

| | | | |
|---|---|---|---|
| CN | 10107105 | A | 11/2007 |
| CN | 101460803 | B | 5/2011 |
| EP | 0729003 | A2 | 8/1996 |
| KR | 10-1998-0065246 | A | 10/1998 |
| KR | 10-2010-0102613 | A | 9/2010 |
| RU | 2445566 | C1 | 3/2012 |
| WO | WO 2010/064975 | A2 | 6/2010 |
| WO | WO 2010/069874 | A1 | 6/2010 |

OTHER PUBLICATIONS

English translations of the Chinese Office Action and Search Report, dated May 9, 2017, for Chinese Application No. 201480069362.4.
English translation of the Russian Decision on Grant, dated Jul. 18, 2017, for Russian Application No. 2016128890.

* cited by examiner

HEAT TRANSFER PLATE AND PLATE HEAT EXCHANGER

TECHNICAL FIELD

The invention relates to a heat transfer plate and a plate heat exchanger comprising such a heat transfer plate.

BACKGROUND ART

Plate heat exchangers, PHEs, typically consist of two end plates in between which a number of heat transfer plates are arranged in an aligned manner, i.e. in a stack. In one type of well-known PHEs, the so called gasketed PHEs, gaskets are arranged between the heat transfer plates, typically in gasket grooves which run along edges of the heat transfer plates, edge portions extending between the gasket grooves and the plate edges. The end plates, and therefore the heat transfer plates, are pressed towards each other whereby the gaskets seal between the heat transfer plates. The gaskets define parallel flow channels between the heat transfer plates, one channel between each pair of heat transfer plates, through which channels two fluids of initially different temperatures alternately can flow for transferring heat from one fluid to the other.

The heat transfer plates are typically made by cutting out blanks from sheets or coils of stainless steel and pressing these blanks with a pattern adapted to the intended application of the heat transfer plates. The resulting heat transfer plates typically have corrugated edge portions, i.e. edge portions comprising ridges and valleys, to increase the strength of the individual heat transfer plates and also the stack of heat transfer plates in that the ridges and valleys of the individual heat transfer plates may abut against each other in the stack. Another important function of the corrugated edge portions is to support the gaskets and keep them in place. The blank cutting may result in deformation of the blank edges, which, depending on the type of stainless steel, in turn may result in deformation martensite or deformation hardening of the blank edges. Deformation martensite is very hard and brittle and may therefore cause problem when the blanks are pressed. More particularly, the tensile stress resulting from the pressing may cause cracks in the edge portions of the resulting heat transfer plates due to the deformation martensite, which cracks typically run perpendicularly to the plate edges.

SUMMARY

An object of the present invention is to provide a heat transfer plate, i.e. a blank pressed with a pattern, which heat transfer plate is associated with a relatively low, or even no, occurrence of cracks caused by blank pressing, even if the blank should contain deformation martensite, but which heat transfer plate still is strong and may support a gasket properly. The basic concept of the invention is to adapt the pressing pattern to material characteristics of different portions of the blank such that blank portions which are relatively rich in deformation martensite are more gently pressed than blank portions which are relatively poor in, or completely lacking, deformation martensite and which therefore are more formable.

The heat transfer plate for achieving the object above is defined in the appended claims and discussed below.

A heat transfer plate according to the invention comprises an edge portion extending along an edge of the heat transfer plate. The edge portion is corrugated so as to comprise alternately arranged ridges and valleys as seen from a first side of the heat transfer plate, which ridges and valleys extend perpendicularly to the edge of the heat transfer plate. A first one of the ridges has a top portion extending in a top portion plane, and a first one of the valleys, which is adjacent to the first ridge, has a bottom portion extending in a bottom portion plane. The top portion of the first ridge and the bottom portion of the first valley are connected by a main flank and they end, just like the main flank, at an end distance from the edge of the heat transfer plate. The heat transfer plate is characterized in that a slope of the main flank, in relation to the bottom portion plane, as seen from the bottom portion of the first valley, is varying between a minimum slope and a maximum slope along the top portion of the first ridge and the bottom portion of the first valley.

A smaller main flank slope may correspond to a more gentle pressing and a relatively "smooth" edge portion contour. On the contrary, a larger main flank slope may correspond to a more "aggressive" pressing and a relatively "edgy" edge portion contour. Thereby, in accordance with the invention, different portions of the heat transfer plate edge portion may be differently pressed which may result in less heat transfer plate cracks.

The heat transfer plate may be such that a first slope of the main flank at a first distance from the edge of the heat transfer plate is smaller than a second slope of the main flank at a second distance from the edge of the heat transfer plate, the first distance being smaller than the second distance. Accordingly, the edge portion of the heat transfer plate may be relatively gently pressed closer to the edge, which may be relatively brittle, such that the risk of crack formation in the edge portion is relatively small. At the same time the edge portion may be pressed relatively "tough" farther away from the edge, whereby the edge portion may still be strong and capable of providing strength to a package or stack of heat transfer plates as well as adequate gasket support.

The heat transfer plate may be such that the top portion plane and the bottom portion plane are parallel to a center extension plane of the heat transfer plate. This may mean that a height of the first ridge, and a depth of the first valley, height and depth directions being perpendicular to said center extension plane of the heat transfer plate, are essentially constant within the top portion and bottom portion, respectively. Here, a larger main flank slope may result in a wider top and/or bottom portion, a width direction being parallel to the plate edge and said center extension plane of the heat transfer plate, and vice versa. As mentioned by way of introduction, a plate heat exchanger may comprise a number of heat transfer plates arranged in a stack between two end plates. The heat transfer plates in the stack may all be similar or they may be of different types. In either case, the ridges and valleys of the edge portion of one heat transfer plate are typically arranged to abut a respective one of the valleys and the ridges, respectively, of the adjacent heat transfer plates. In that the top portion and bottom portion of the first ridges and first valley, respectively, are plane and parallel to said heat transfer plate center extension plane, a relatively large, well defined and stable contact portion may be obtained between the first ridge and the first valley and a corresponding valley and a corresponding ridge, respectively, of edge portions of the neighbouring heat transfer plates.

The heat transfer plate may be such that the slope of the main flank at said end distance, i.e. where the top portion of the first ridge and the bottom portion of the first valley end, is said maximum slope. Such an embodiment may be associated with an optimized gasket support.

The first ridge and the first valley may extend from the edge of the heat transfer plate. This is beneficial to the strength of the edge portion of the heat transfer plate, and also to the strength of a package or stack containing the heat transfer plate, since abutment all the way to the edge between the heat transfer plate and neighbouring heat transfer plates is enabled.

The heat transfer plate may be such that the slope of the main flank at the edge of the heat transfer plate is said minimum slope. This embodiment means that the edge portion of the heat transfer plate is most gently pressed at the very edge of the same where cracks due to deformation martensite, typically, is most likely to occur.

Said minimum slope may correspond to a minimum smallest angle $\alpha$min measured between a part of the bottom portion plane extending under the first ridge and the main flank, and said maximum slope may correspond to a maximum smallest angle $\alpha$max measured between said part of the bottom portion plane and the main flank, said minimum smallest angle $\alpha$min being between 3 and 20 degrees smaller than said maximum smallest angle $\alpha$max.

The attribute "smallest" as regards the angles above is used to differentiate between the two angles than can be measured between said part of the bottom portion plane and the main flank at a specific distance from the heat transfer plate edge, one of the angles being measured from the main flank in clockwise direction and the other angle being measured from the main flank in counter clockwise direction.

The slope of the main flank may be essentially constant between a third and a fourth distance from the edge of the heat transfer plate, the fourth distance being larger than the third distance, and the third distance being larger than the first distance. Thereby, the edge portion may be "toughly" pressed where cracks are not likely to occur and more gently pressed locally where the risk of cracks is relatively large. This may be advantageous as regards the strength of the heat transfer plate as well as of a package or stack containing the heat transfer plate.

As an example, a difference between the fourth and the third distance may correspond to 0-85% of the end distance which means the slope of the main flank is essentially constant over 0-85% of the extension of the top and bottom portions of the first ridge and the first valley, respectively. Typically, here, a higher percentage may be associated with a stronger heat transfer plate edge portion.

The slope of the main flank may be continuously decreasing from the third distance towards the edge of the heat transfer plate. Thereby, a smooth transition between main flank slopes is enabled which may facilitate the manufacturing of the heat transfer plate, more particularly the pressing of the blank from which the heat transfer plate is formed.

A plate heat exchanger according to the present invention comprises a heat transfer plate as described above.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
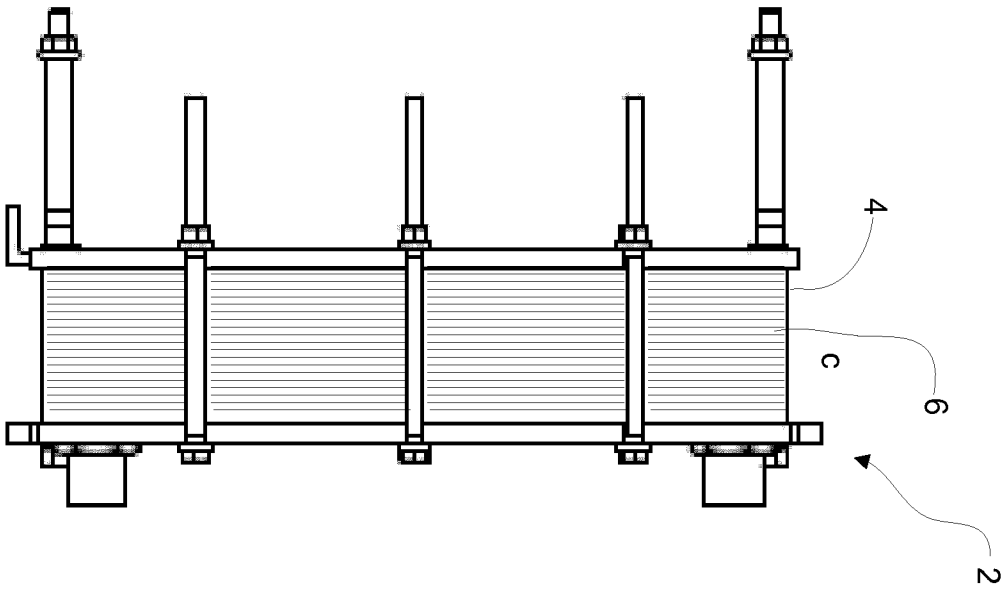
FIG. 1 is a schematic side view of a plate heat exchanger.

FIG. 1 illustrates a gasketed plate heat exchanger 2 comprising a plurality of heat transfer plates arranged in a plate pack 4. The construction and function of a gasketed plate heat exchanger as such is well known, and was briefly discussed by way of introduction, and will not be described in detail herein. One of the heat transfer plates of the plate pack 4 is denoted 6 and illustrated in further detail in FIGS. 2-5.

Figure 2:
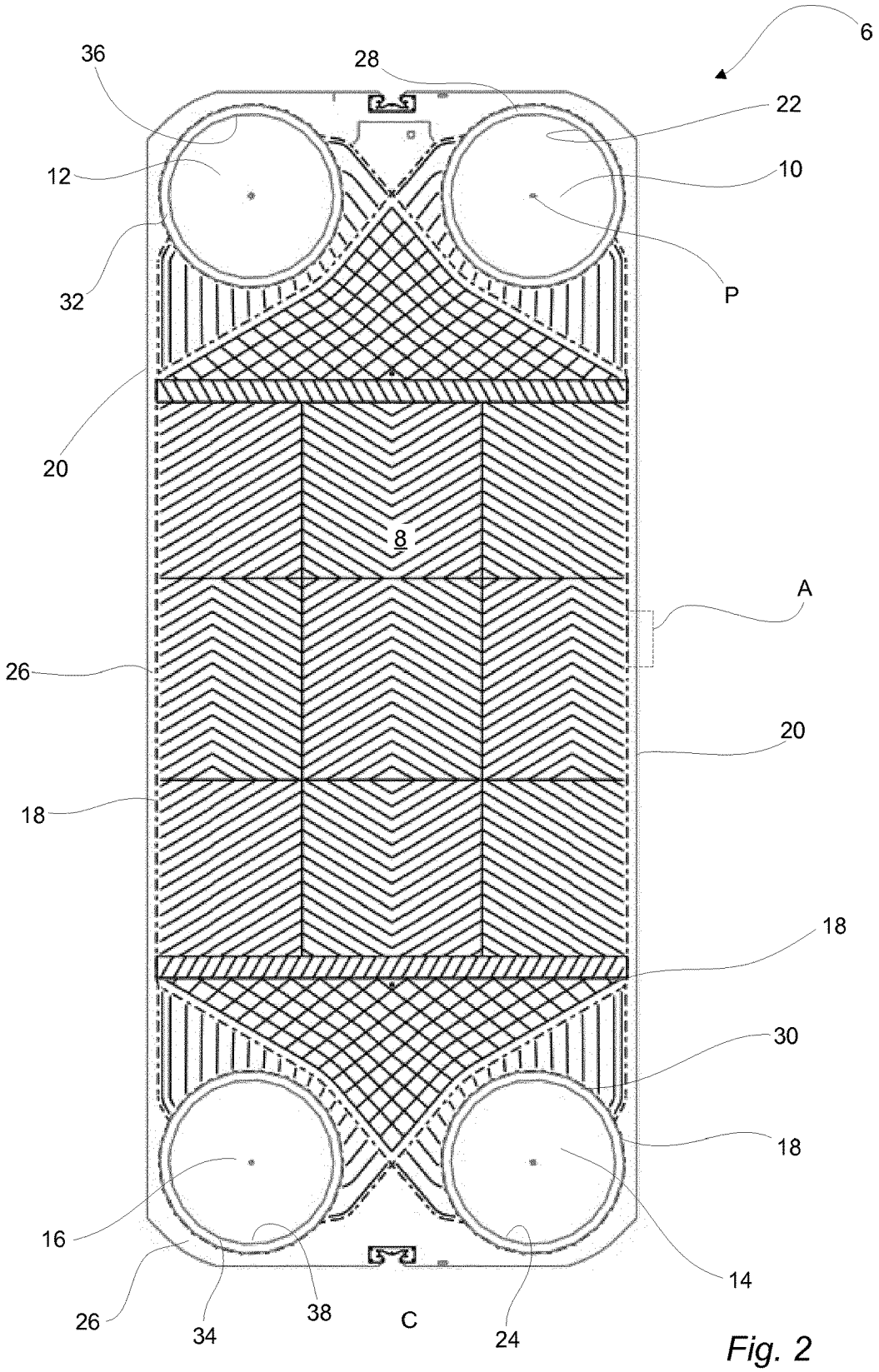
FIG. 2 is a schematic plan view of a heat transfer plate.
Figure 3:
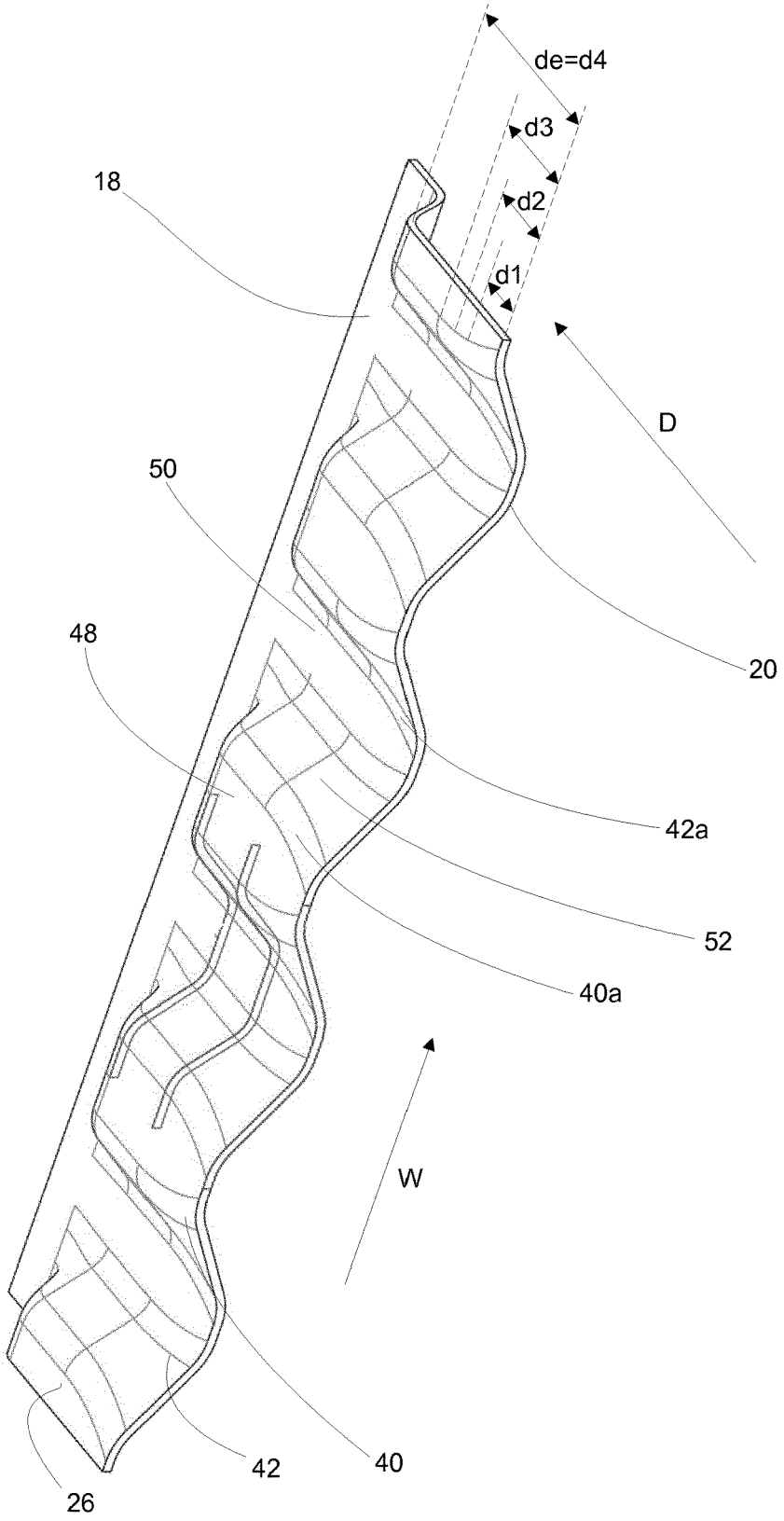
FIG. 3 is an enlargement of a part of the heat transfer plate of FIG. 2 seen in perspective view.
Figure 4:
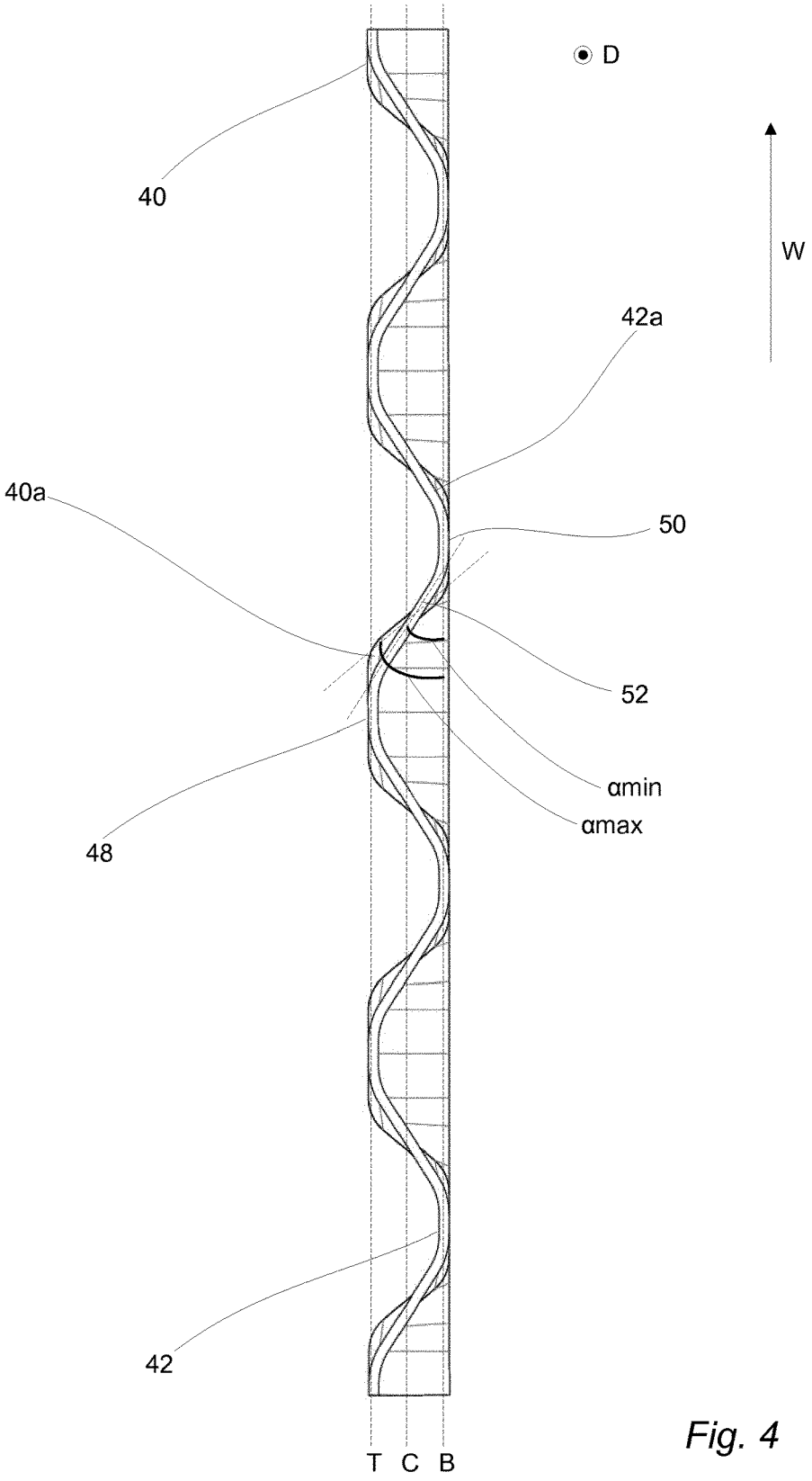
FIG. 4 is an enlargement of a part of the heat transfer plate of FIG. 2 seen in side view, FIG. 5*a* schematically illustrates a cross section of a part of the heat transfer plate of FIG. 2, FIG. 5*b* schematically illustrates a side view of a part of the heat transfer plate of FIG. 2, FIG. 6*a* schematically illustrates a cross section, corresponding to that of FIG. 5*a*, of a conventional heat transfer plate, and FIG. 6*b* schematically illustrates a side view, corresponding to that of FIG. 5*b*, of a conventional heat transfer plate.

FIG. 2 illustrates the complete heat transfer plate 6 while FIGS. 3 and 4 each show an enlargement of a part of the heat transfer plate enclosed by the dashed rectangle A in FIG. 2. The essentially rectangular heat transfer plate 6, of which a first side 8 is visible in the figures, is produced by cutting out a blank from a coil of stainless steel alloy 304 and press this blank with a predetermined pattern. The blank comprises a number of cut holes corresponding to port holes 10, 12, 14 and 16 of the heat transfer plate 6. The function of the port holes is well-known and will not be described herein. As was discussed by way of introduction, stainless steel cutting may result in deformation hardening, more particularly formation of martensite, at cut surfaces, i.e. at edges, of the blank.

Figure 5A:
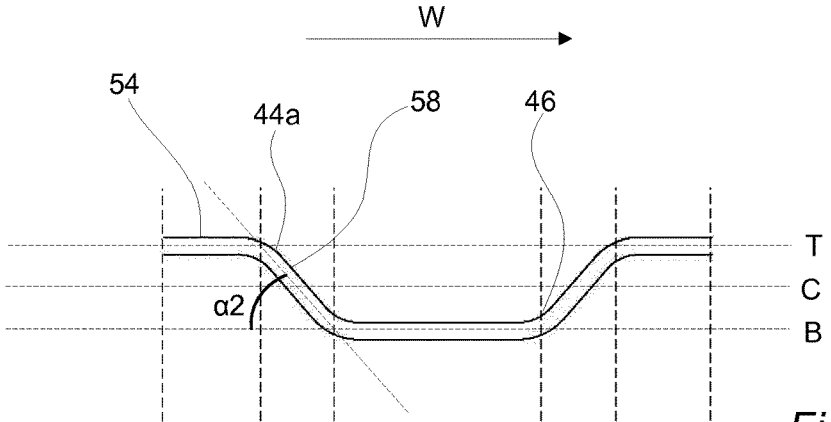
Figure 5B:
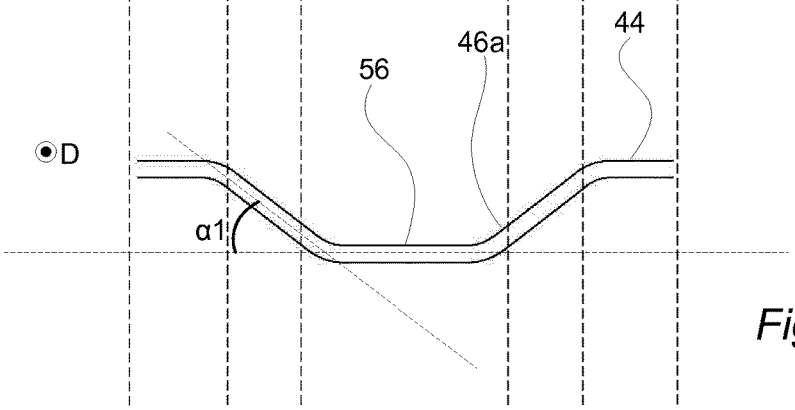

The heat transfer plate 6 comprises a gasket groove 18 extending along an outer plate edge 20 to enclose the port holes 10, 12, 14 and 16, and completely along two inner plate edges 22 and 24 defining the two port holes 10 and 14, respectively, to separately enclose these. Further, the gasket groove 18 extends twice "diagonally" across the heat transfer plate so as to further enclose the port holes 10 and 14. The heat transfer plate 6 further comprises an outer edge portion 26 extending between the gasket groove 18 and the outer plate edge 20 and two inner edge portions 28 and 30 extending between the gasket groove 18 and the inner plate edges 22 and 24, respectively. Inner edge portions 32 and 34, similar to the inner edge portions 28 and 30, also extend along a respective one of two inner plate edges 36 and 38 defining the port holes 12 and 16, respectively. The outer edge portion 26 is corrugated so as to comprise alternately arranged ridges 40 and valleys 42 (not illustrated in FIG. 2 but in FIGS. 3 and 4). Moreover, the inner edge portions 28 and 30 are corrugated so as to comprise alternately arranged ridges 44 and valleys 46 (FIGS. 5*a* and 5*b*). Similarly, the inner edge portions 32 and 34 are corrugated but this is not illustrated herein.

The part of the outer edge portion 26 illustrated in FIGS. 3 and 4 is located at a long side of the heat transfer plate 6. The ridges 40, just like the valleys 42, along the long sides of the heat transfer plate are all similar. However, to explain the invention, the following discussion will be directed towards a first ridge 40*a* and a first valley 42*a*, which first ridge and first valley are adjacent. The first ridge 40*a* and the first valley 42*a* extend perpendicularly to the outer plate edge 20. The first ridge 40*a* has a top portion 48 extending in a top portion plane T, and the first valley 42*a* has a bottom portion 50 extending in a bottom portion plane B. Also the gasket groove 18 extend in the bottom portion plane B. As is clear from FIGS. 3 and 4, the top portion plane T and the bottom portion plane B are parallel to a center extension plane C of the heat transfer plate 6, i.e. parallel to a figure plane of FIG. 2. The center extension plane C defines the transition between the first ridge and the first valley. The top portion 48 of the first ridge 40*a* and the bottom portion 50 of the first valley 42*a* are connected by a main flank 52.

The first ridge 40*a* and the first valley 42*a* extend from the outer plate edge 20 and towards an interior of the heat transfer plate 6, their top and bottom portions 48 and 50, and therefore the main flank 52, ending at an end distance de from the outer plate edge 20. The outer edge portion 26 is differently pressed within the end distance de from the outer plate edge. This is clear from FIGS. 3 and 4 in which it can be seen that a cross section through the first ridge 40*a* and the first valley 42*a* taken parallel to the outer plate edge 20 is varying in a direction D which is perpendicular to the outer plate edge 20 and parallel to the center extension plane C of the heat transfer plate 6. More particularly, a slope of the main flank 52 in relation to the bottom portion plane B, as seen from the bottom portion 50 of the first valley 42*a*, is varying along the direction D. Further, a width of the top portion 48 of the first ridge 40*a*, just like a width of the bottom portion 50 of the first valley 42*a*, is varying along the direction D, a width direction W being perpendicular to the direction D and parallel to the center extension plane C of the heat transfer plate 6. In that a height of the first ridge and a depth of the first valley is constant within the top portion and bottom portion, respectively, a steeper main flank slope corresponds to a wider ridge top portion and/or a wider valley bottom portion, here wider ridge top and valley bottom portions, and a "tough" pressing of the heat transfer plate. Similarly, a less steep main flank slope corresponds to more narrow ridge top portion and/or a more narrow valley bottom portions, here more narrow ridge top and valley bottom portions, and a more "gentle" pressing of the heat transfer plate.

Within the end distance de from the outer plate edge 20, the heat transfer plate 6 is more gently pressed close to the outer plate edge than close to the gasket groove 18. Thus, a first slope of the main flank 52 at a first distance d1 from the outer plate edge 20 is smaller than a second slope of the main flank 52 at a second distance d2 from the outer plate edge, $d1<d2\leq de$. In other words, with reference to a smallest angle $\alpha x$ measured between a part of the bottom portion plane B extending under the first ridge 40*a* and the main flank 52, the smallest angle $\alpha 1$ at the distance d1 is smaller than the smallest angle $\alpha 2$ at the distance d2, $d1<d2\leq de$, $\alpha x$, $\alpha 1$ and $\alpha 2$ not being illustrated in the figures.

The slope of the main flank 52 varies between a maximum slope, corresponding to a maximum smallest angle $\alpha max$, and a minimum slope, corresponding to a minimum smallest angle $\alpha min$, along the top portion 48 of the first ridge 40*a* and the bottom portion 50 of the first valley 42*a*. In this example, the maximum smallest angle $\alpha max$ is 49.4 degrees while the minimum smallest angle $\alpha min$ is 32.4 degrees. As is clear from FIGS. 3 and 4, the slope of the main flank 52 is maximum at the end distance de from the outer plate edge 20 of the heat transfer plate 6, i.e. at the end of the ridge top and valley bottom portions 48 and 50. Further, the slope of the main flank is minimum at the very outer plate edge 20. As previously described, a main flank slope varying like this is associated with a low risk of crack formation and good gasket support.

A transition between the maximum slope and the minimum slope could be linear throughout. However, in this example, as seen from the outer plate edge 20 towards the gasket groove 18, the main flank slope is continuously increasing at first, more particularly to a third distance d3 from the outer edge 20. Thereafter, the main flank slope is constant to a fourth distance d4 from the outer plate edge 20. Here, the fourth distance d4 is equal to the end distance de which means that the constant slope is the maximum slope. In the above example the different distances are as follows: de=d4=10 mm, d1=2.5 mm, d2=4 mm and d3=5 mm. This means that the main flank slope is constant and maximum along 50% of the extension of the main flank 52. As previously described, here, a maximum slope along a large part of the main flank extension means large ridge top and valley bottom portions which, in turn, is associated with a strong heat transfer plate.

Thus, for the heat transfer plate 6 the main flank slope within the outer edge portion 26 is varying along the ridge top portion 48 and the bottom valley portion 50 which makes the plate less prone to crack formation while it is still strong and capable of providing good gasket support. For a conventional heat transfer plate the main flank slope within the outer edge portion is essentially constant along the ridge top and bottom valley portions. The conventional plate may therefore be relatively prone to crack formation.

Figure 6A:
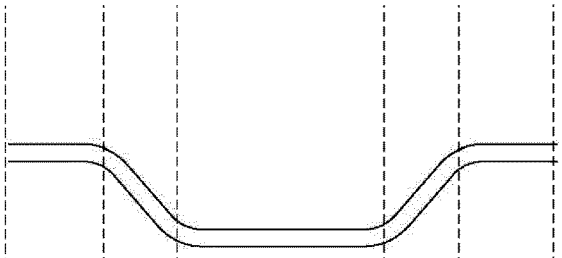
Figure 6B:
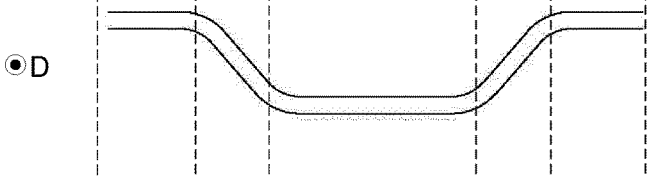

Above it has been described how the main flank slope is varying within the outer edge portion 26 of the heat transfer plate 6. Additionally/alternatively, a slope of a main flank within one or more of the inner edge portions 28, 30, 32 and 34, i.e. around the port holes 10, 14, 12 and 16, respectively, may vary. This is shown in FIGS. 5*a* and 5*b*. FIG. 5*a* illustrate a partial cross section of the inner edge portion 28 at a second distance d2 from the inner plate edge 22. FIG. 5*b* illustrate a part of the inner plate edge 22 in side view, i.e. a partial cross section of the inner edge portion 28 at a first distance d1=0 from the inner plate edge 22. FIGS. 6*a* and 6*b* correspond to FIGS. 5*a* and 5*b* but illustrate a conventional heat transfer plate, a comparison between FIGS. 5*a* and 5*b* & FIGS. 6*a* and 6*b* further elucidating the present invention.

The ridges, just like the valleys, within the inner edge portions are all similar. However, to explain the invention, the following discussion will be directed towards one of the ridges and the valley visible in FIGS. 5*a* and 5*b*, i.e. a first ridge 44*a* and a first valley 46*a*, which first ridge and first valley are adjacent. The first ridge 44*a* and the first valley 46*a* extend perpendicularly to the inner plate edge 22 of the heat transfer plate 6, i.e. along a respective imaginary line extending diametrically through a center point P (FIG. 2) of the port hole 10. The first ridge 44*a* has a top portion 54 extending in the top portion plane T, and the first valley 46*a* has a bottom portion 56 extending in the bottom portion plane B. The center extension plane C defines the transition between the first ridge and the first valley. The top portion 54 of the first ridge 44*a* and the bottom portion 56 of the first valley 46*a* are connected by a main flank 58.

The first ridge 44*a* and the first valley 46*a* extend from the inner plate edge 22 and towards an interior of the heat transfer plate 6, their top and bottom portions 54 and 56 ending at an end distance de from the inner plate edge 22. Just like the outer edge portion 26, the inner edge portion 28 of the heat transfer plate 6 is differently pressed within the end distance de from the inner plate edge 22. More particularly, a slope of the main flank 58 in relation to the bottom portion plane B, as seen from the bottom portion 56 of the first valley 46*a*, is varying along the direction D. Further, as is clear from FIGS. 5*a* and 5*b*, a width of the top portion 54 of the first ridge 44*a*, just like a width of the bottom portion 56 of the first valley 46*a*, is varying along the direction D, the width direction being defined as above. This is a result of two factors. The first factor is the extension of the inner plate edge 22. The fact that inner plate edge extends circularly means that the top portion width and/or the bottom portion width, here the top and bottom portion widths, will increase from the inner plate edge towards the plate interior. The second factor is the varying main flank slope. Just like within the outer edge portion 26, a steeper main flank slope here corresponds to wider ridge top and valley bottom portions, while a less steep main flank slope corresponds to more narrow ridge top and valley bottom portions.

Just like at the outer plate edge 20, within the end distance de from the inner plate edge 22, the heat transfer plate 6 is more gently pressed close to the inner plate edge than close to the gasket groove 18. Thus, a first slope of the main flank 58 at the first distance d1 from the inner plate edge 22 is smaller than a second slope of the main flank 58 at the second distance d2 from the inner plate edge, $d1<d2\leq de$, here d2=de. In other words, with reference to a smallest angle $\alpha x$ (not illustrated in the figures) measured between a part of the bottom portion plane B extending under the first ridge 44 *a* and the main flank 58, the smallest angle $\alpha 1$ at the first distance d1 is smaller than the smallest angle $\alpha 2$ at the second distance d2, as is illustrated in FIGS. 5*a* and 5*b* with d1=0 and d2=de.

The slope of the main flank 58 varies between a maximum slope, corresponding to a maximum smallest angle $\alpha max$, and a minimum slope, corresponding to a minimum smallest angle $\alpha min$, along the top portion 54 of the first ridge 44*a* and the bottom portion 56 of the first valley 46*a*. In this example, the maximum smallest angle $\alpha max$ is 49 degrees while the minimum smallest angle $\alpha min$ is 38 degrees. The slope of the main flank 58 is maximum at the end distance de from the inner plate edge 22, i.e. at the end of the ridge top and valley bottom portions 54 and 56, wherein $\alpha max=\alpha 2$. Further, the slope of the main flank 58 is minimum at the very inner plate edge 22, wherein $\alpha min=\alpha 1$. As seen from the inner plate edge 22 towards the gasket groove 18, the main flank slope is continuously increasing to the maximum slope which thus is reached at the distance de from the inner plate edge, here de=8 mm.

FIGS. 6*a* and 6*b* illustrate how the slope of the main flank varies around one of the port holes of a heat transfer plate according to prior art, which prior art heat transfer plate, except for regarding the pressing of the outer and inner edge portions, is similar to the heat transfer plate 6 illustrated in the rest of the figures. The slope of the main flank at the distance d2, i.e. the end distance de, from the inner plate edge defining the port hole is the same for the heat transfer plate 6 and the prior art heat transfer plate (FIGS. 5*a* and 6*a*) while the slope of the main flank at the distance d1, at the very inner plate edge, is smaller for the heat transfer plate 6 than for the prior art heat transfer plate (FIGS. 5*b* and 6*b*). More particularly, for the prior art plate, the slope of the main flank is not varying but constant. Further, as is clear from FIGS. 6*a* and 6*b*, a width of the ridge top and valley bottom portions, is varying along the direction D. This is a result of the circular extension of the inner plate edge 22, only. Thereby, the top and bottom width variations are less for the prior art plate than for the plate according to the present invention.

It should be stressed that the distances and main flank slopes characterizing the outer edge portion 26 may differ from, or be similar to, those characterizing the inner edge portions 28, 30, 32 and 34.

The above described embodiment of the present invention should only be seen as an example. A person skilled in the art realizes that the embodiment discussed can be varied in a number of ways without deviating from the inventive conception.

For example, the main flank slopes and distances, and the relationships between them, may be different than specified above. Specifically, the minimum slope, i.e. the minimum smallest angle $\alpha min$ measured between a part of the bottom portion plane extending under the first ridge and the main flank, may be between 3 and 20 degrees smaller than the maximum slope, i.e. the maximum smallest angle $\alpha max$ between the bottom portion plane and the main flank. Further, the slope of the main flank within the outer edge portion may be constant along 0-85% of the extension of the ridge top and valley bottom portions.

The ridges and valleys need not extend from the plate edges but could commence at a distance from the plate edges and extend inwards.

The main flank slopes within the edge portions may vary in other ways than above described. As an example, the main flank slope could vary along the complete extension of the ridge top and valley bottom portions also within the outer edge portion (so as to not comprise a part with constant main flank slope). As another example, the main flank slope could vary linearly along part of/the complete extension of the ridge top and valley bottom portions. As yet another example, the slope of the main flank within the inner edge portions could be constant along a part of the ridge top and valley bottom portions.

The ridges and valleys within the inner edge portions, just like those within the outer edge portion, of the heat transfer plate need not be similar. Thus, the main flank slope may vary in different ways within different portions of the inner and outer edge portions. Also, the main flank slope may vary within some portions and be constant within other portions. As an example, the main flank slope may vary as described above, not only on the long sides, but also on the short sides, of the heat transfer plate.

The present invention can be used in connection with alternative heat transfer plate designs, for example a heat transfer plate with a different gasket groove extension across the plate or a gasket groove that extends in a plane different from the plane of the valleys. Further, the invention can be used in connection with alternative heat transfer plate materials.

Finally, the present invention could be used in connection with other types of plate heat exchangers than purely gasketed ones, e.g. plate heat exchangers comprising permanently joined heat transfer plates.

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The present invention could be combined with the invention described in applicant's copending European patent application titled "ATTACHMENT MEANS, GASKET ARRANGEMENT, HEAT EXCHANGER PLATE AND ASSEMBLY" filed on the same day as the present European patent application.

The invention claimed is:

1. A heat transfer plate comprising:

an edge portion extending along an edge of the heat transfer plate, the edge portion being corrugated so as to comprise alternately arranged ridges and valleys as seen from a first side of the heat transfer plate, wherein the ridges and the valleys extend perpendicularly to the edge of the heat transfer plate, a first one of the ridges having a top portion extending in a top portion plane, and a first one of the valleys, which is adjacent to the first ridge, having a bottom portion extending in a bottom portion plane, wherein the top portion of the first ridge and the bottom portion of the first valley are connected by a main flank, the top portion of the first ridge, the bottom portion of the first valley and the main flank ending at an end distance from the edge of the heat transfer plate, wherein a slope of the main flank in relation to the bottom portion plane as seen from the bottom portion of the first valley varies between a minimum slope and a maximum slope along the top portion of the first ridge and the bottom portion of the first valley, and wherein a first slope of the main flank at a first distance from the edge of the heat transfer plate is smaller than a second slope of the main flank at a second distance from the edge of the heat transfer plate, the first distance being smaller than the second distance.

2. The heat transfer plate according to claim 1, wherein said minimum slope corresponds to a minimum angle ($\alpha$min) measured between a part of the bottom portion plane extending under the first ridge and the main flank, and said maximum slope corresponds to a maximum angle ($\alpha$max) measured between said part of the bottom portion plane and the main flank, said minimum angle ($\alpha$min) being at least 3 degrees smaller than said maximum angle ($\alpha$max).

3. The heat transfer plate according to claim 2, wherein said minimum angle ($\alpha$min) is smaller than said maximum angle ($\alpha$max) by 20 degrees or less.

4. The heat transfer plate according to claim 1, wherein the slope of the main flank is constant between a third distance and a fourth distance from the edge of the heat transfer plate, the fourth distance being larger than the third distance and the third distance being larger than the first distance.

5. The heat transfer plate according to claim 4, wherein a difference between the fourth distance and the third distance corresponds to 0-85% of the end distance.

6. The heat transfer plate according to claim 4, wherein the slope of the main flank is continuously decreasing from the third distance towards the edge of the heat transfer plate.

7. The heat transfer plate according to claim 1, wherein the top portion plane and the bottom portion plane are parallel to a center extension plane of the heat transfer plate.

8. The heat transfer plate according to claim 1, wherein the slope of the main flank at said end distance is said maximum slope.

9. The heat transfer plate according to claim 1, wherein the first ridge and the first valley extend from the edge of the heat transfer plate.

10. The heat transfer plate according to claim 1, wherein the slope of the main flank at the edge of the heat transfer plate is said minimum slope.

11. A plate heat exchanger comprising the heat transfer plate according to claim 1.

* * * * *